US005946960A

United States Patent [19]

Lanticina

[11] Patent Number: 5,946,960

[45] Date of Patent: Sep. 7, 1999

[54] BENDING MACHINE FOR BENDING PIPES AND WIRE-LIKE MATERIAL IN GENERAL

[75] Inventor: Maurizio Lanticina, Como, Italy

[73] Assignee: BLM S.p.A., Cantu, Italy

[21] Appl. No.: 09/040,962

[22] Filed: Mar. 18, 1998

[30] Foreign Application Priority Data

Mar. 21, 1997 [IT] Italy ..... MI97A0643

[51] Int. Cl.[6] ..... B21D 7/024

[52] U.S. Cl. ..... 72/149; 72/307

[58] Field of Search ..... 72/307, 306, 388, 72/217, 149, 151, 159, 157

[56] References Cited

U.S. PATENT DOCUMENTS

| | | | |
|---|---|---|---|
| 2,743,756 | 5/1956 | Fredericks | 72/151 |
| 3,062,266 | 11/1962 | Abbott | 72/151 |
| 3,096,807 | 7/1963 | De Marco | 72/156 |
| 4,048,826 | 9/1977 | Lechner | 72/139 |
| 4,269,054 | 5/1981 | Eaton | 72/151 |
| 4,313,324 | 2/1982 | Pearson | 72/307 |
| 4,485,658 | 12/1984 | Stewart | 72/149 |
| 5,010,758 | 4/1991 | Togoshi | 72/157 |

FOREIGN PATENT DOCUMENTS

| | | |
|---|---|---|
| 0 227 429 | 7/1987 | European Pat. Off. . |
| 0 417 703 | 3/1991 | European Pat. Off. . |

OTHER PUBLICATIONS

European Search Report dated Nov. 2, 1998.

*Primary Examiner*—Daniel C. Crane

[57] ABSTRACT

A machine (1) for bending pipes and wire-like material in general comprises, on a bed (2), a bending head (20) and a plate (5) supporting a carriage provided with a gripper (10) for gripping the end portion of the workpiece opposite to the bending head (20), by providing a shaft (6) extending from the bottom surface (7) of the plate (5), the shaft (6) being rotatably housed in the bed (2) and being operatively coupled with controllable driving means.

8 Claims, 4 Drawing Sheets

BENDING MACHINE FOR BENDING PIPES AND WIRE-LIKE MATERIAL IN GENERAL

CROSS REFERENCE TO RELATED APPLICATION

The present invention is related to U.S. patent application Ser. No. 09/040,964 entitled "Bending Machine for Bending Wire-like Material, Such as Pipes, Rods or Section Members", filed on Mar. 18, 1998.

BACKGROUND OF THE INVENTION

The present invention relates to a machine for bending pipes and wire-like material in general, comprising a machine bed supporting a bending head and a carriage provided for gripping the end of the workpiece opposite to the bending head.

Prior bending machines for bending wire-like materials, such as rods or pipes, mainly comprise a machine bed supporting a plate with a carriage provided with a gripper which is controllably driven, and a head including a curing unit also of a servocontrolled type.

The gripper is so designed as to grip a rod or pipe length for adjustably displacing and turning said length along the axis thereof. The head is operatively coupled to the machine bed so as to adjust its position transversal of the gripper axis by small displacements.

Such an arrangement of the bending machine allows to align a die, provided on a bending unit connected to the head, with the axis of the rod or pipe length gripped by the gripper. Thus, it will be possible to engage the rod or pipe length in a recess formed in the die, to bend said length.

Prior bending machines are at present associated with handling devices, such as robots, for automatically supplying and unloading the workpieces, or for sending a machined workpiece to other machining units.

The control, such as the programming, of the mentioned handling units is very difficult.

The requirement of performing a handling operation, and, in particular, an accurate handling of the workpiece, is due to the fact that high making speeds are required and that it is also desired to prevent the bent rod or pipe length from disorderly falling as it is released by the bending arm.

SUMMARY OF THE INVENTION

Accordingly, the main object of the present invention is to overcome the above mentioned drawbacks of the prior art, and, more specifically, to automatically and controllably drive the mentioned rod or pipe lengths without using additional handling units, for example for supplying and unloading the bending machine, while providing a construction wise simple machine including a small number of driving axes.

The objects of the invention are achieved by a bending machine for bending pipes and wire-like material in general, having any desired cross-sections, comprising a machine bed supporting a bending head and a carriage provided with a gripper for gripping a workpiece, characterized in that said machine bed further supports a plate which can swing in a plane about a swinging axis provided at one end of said plate, and that to said plate swinging driving means are operatively coupled.

Advantageously, said driving means are controlled in a continuous manner.

Preferably, in order to cause said plate to swing, a shaft extending from the bottom surface of said plate is provided, said shaft being rotatably housed in said bed and being operatively coupled to driving means.

In order to support the plate on the machine bed, thrust bearings are keyed on the shaft and housed in seats or recesses formed on the machine bed.

In order to provide the swinging movement, a swinging driving cylinder-piston assembly is provided on the bed, the piston of said assembly being operatively coupled to the plate.

According to a different embodiment of the plate swinging driving and control means, a gear wheel is keyed on said shaft, a servo-controlled geared motor being provided on the machine bed, said geared motor being coupled to said gear wheel.

In order to support and drive the plate during the swinging thereof, a guide is provided on the bed surface facing the plate, supporting and sliding shoes being provided on the bottom surface of the plate at said guide.

For preventing an operating stress transversal of the gripper from undesirably deforming, during machining or handling steps, the pipe, rod or section member, the plate can perform small resilient swinging movements about the standby positions thereof, such as the working, loading and unloading positions thereof. To that end, a lever is provided under the plate, said lever being adapted to swing about the swinging axis of the plate, and being provided with an elongated slot housing therein a pin rigid with the bottom surface of the plate, driving means being operatively coupled to said lever and abutments for said plate being supported by springs connected at their free end portions to the bed, at the plate standby positions.

The advantages of the present invention mainly consist of the possibility of directly handling, by the gripper provided on the bending machine carriage, the rod and pipe lengths. For example, it is possible to automatically supply and unload the bending machine without using specifically designed handling devices.

The handling operations for loading the workpieces by causing the plate to swing and the gripper carriage to be displaced, can be performed simultaneously to the unloading of the preceding processed workpiece, thereby reducing the machining times.

The use of a plate supporting the gripper carriage as a handling or machining axis, allows to increase the yield of the machine. In fact, it is possible to exploit the working positions of the gripper in order to bring the workpiece to other machining or processing units, such as drilling, butting, threading or marking devices, in addition to the loading and unloading stations.

BRIEF DESCRIPTION OF THE DRAWINGS

The subject matter according to the present invention will be disclosed and illustrated in a more detailed manner hereinafter, by an embodiment thereof, given as a mere example, with reference to the accompanying drawings, where.

DESCRIPTION OF THE PREFERRED EMBODIMENT

Figure 1:
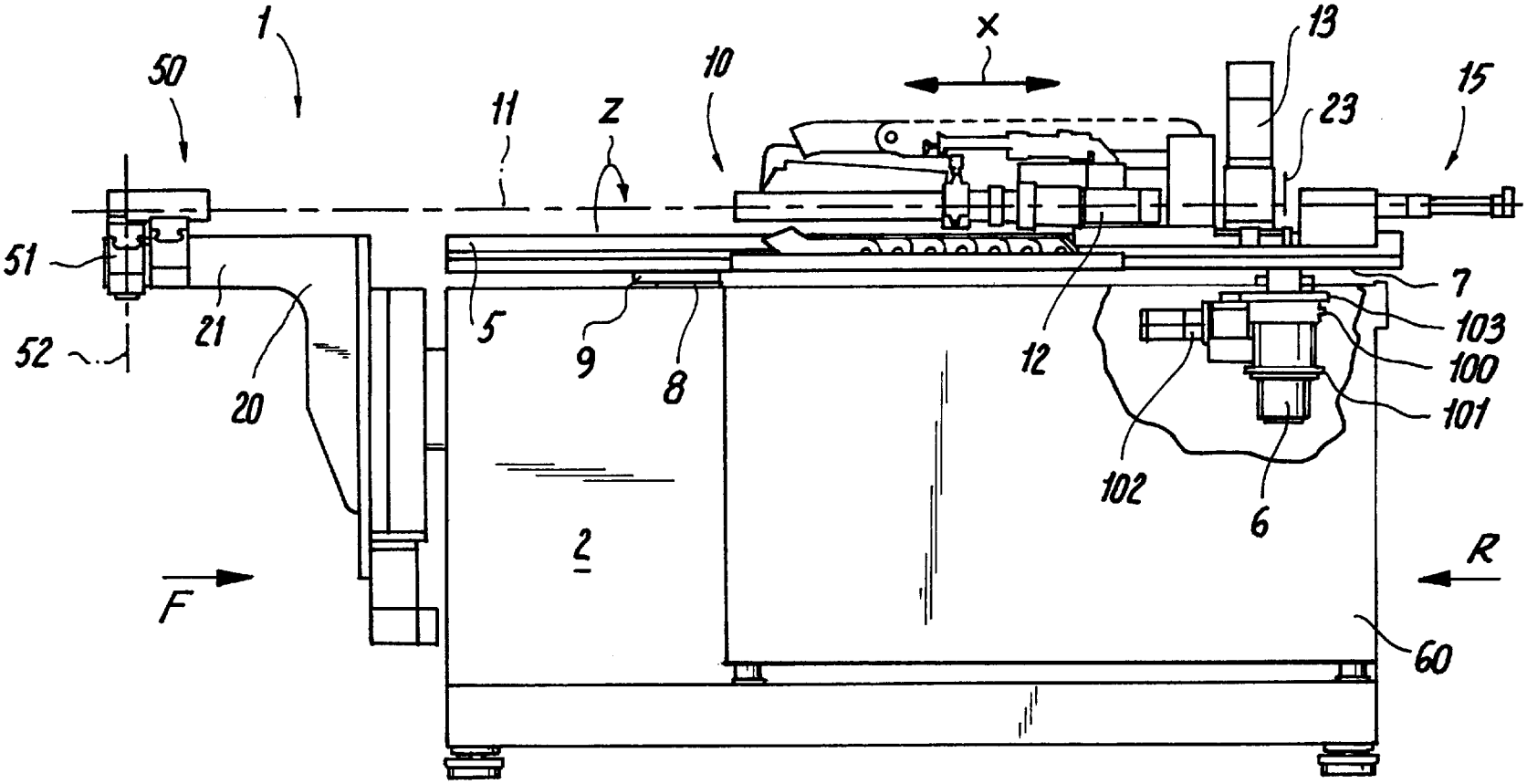
FIG. 1 is a schematic side view, as partially cross-sectioned, of a bending machine.
Figure 2:
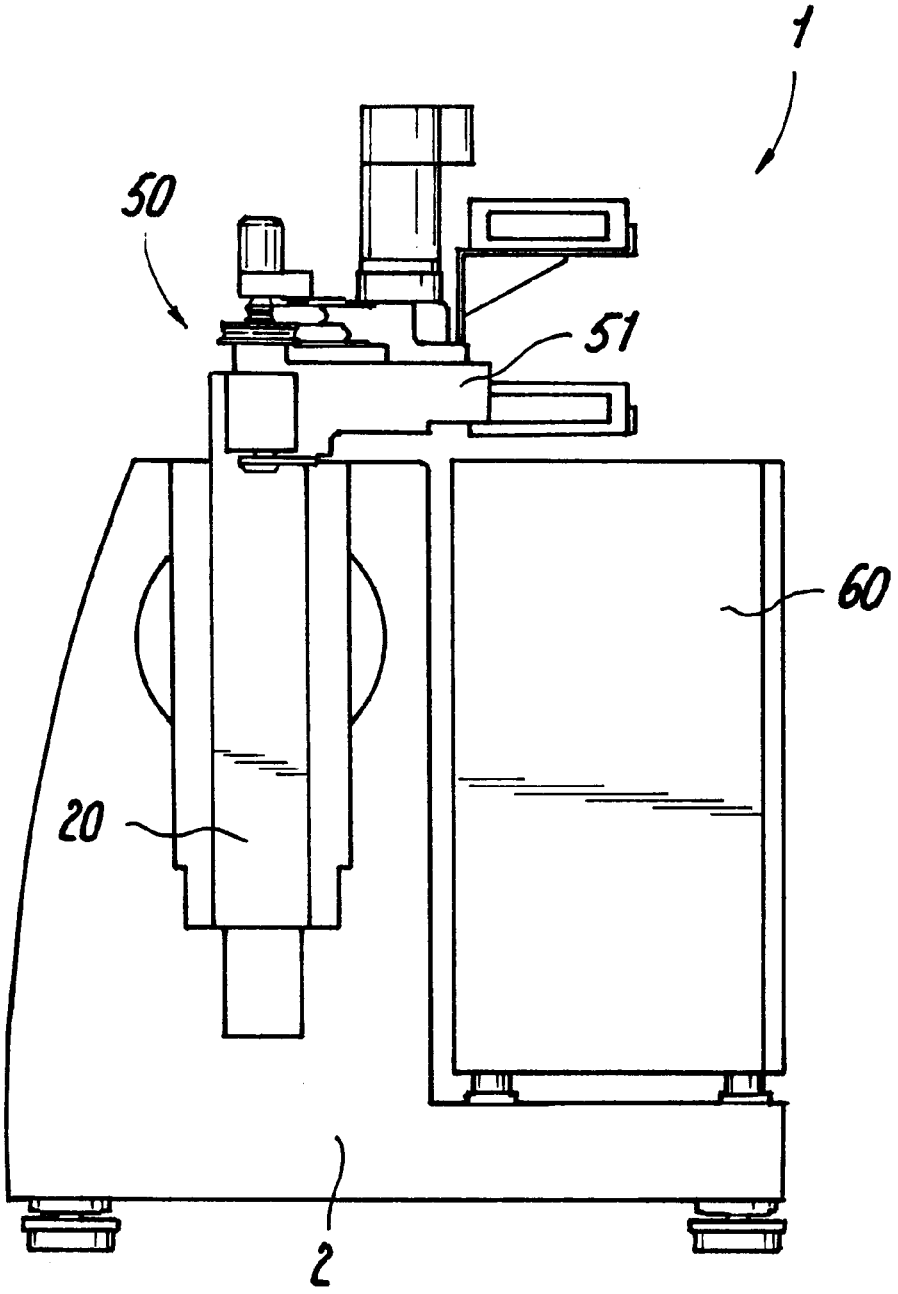
FIG. 2 is a schematic front view of the bending machine with the head thereof arranged at a vertical position.

FIGS. 1 and 2 show the main elements constituting a bending machine for bending wire-like material, which has been generally indicated by 1.

A machine body 2, comprising a prismatic elongated body having a substantially L-shape cross-section, is arranged on a side 3 thereof, the second side thereof 4 being vertically directed.

The two ends of said prismatic elongated body define a front portion (according to the arrow F) and a rear portion (according to the arrow R) of the machine 1.

A plate 5, having, for example, a rectangular configuration in top plan view, is provided on the top of the vertical side 4 of the bed 2.

At the rear portion of the plate 5, a shaft 6 extends from the bottom surface 7 of said plate. The shaft 6 is partially engaged in the top portion of the body of the vertical side 4 of the bed 2.

Supporting and swinging driving means connect the shaft 6 to the machine bed 2. For example, thrust bearings 100, 101 are keyed on the shaft 6 and are housed in seats or recesses formed in the machine bed 2 (not shown).

The shaft 6 defines the swinging axis 23 for the plate 5 on the bed 2.

Swinging driving and control means are operatively coupled to the plate 5.

For example, a servo-controlled geared motor 102 is provided inside the body of the bed 2 and is coupled to a gear wheel 103 keyed on the shaft 6.

Figure 3:
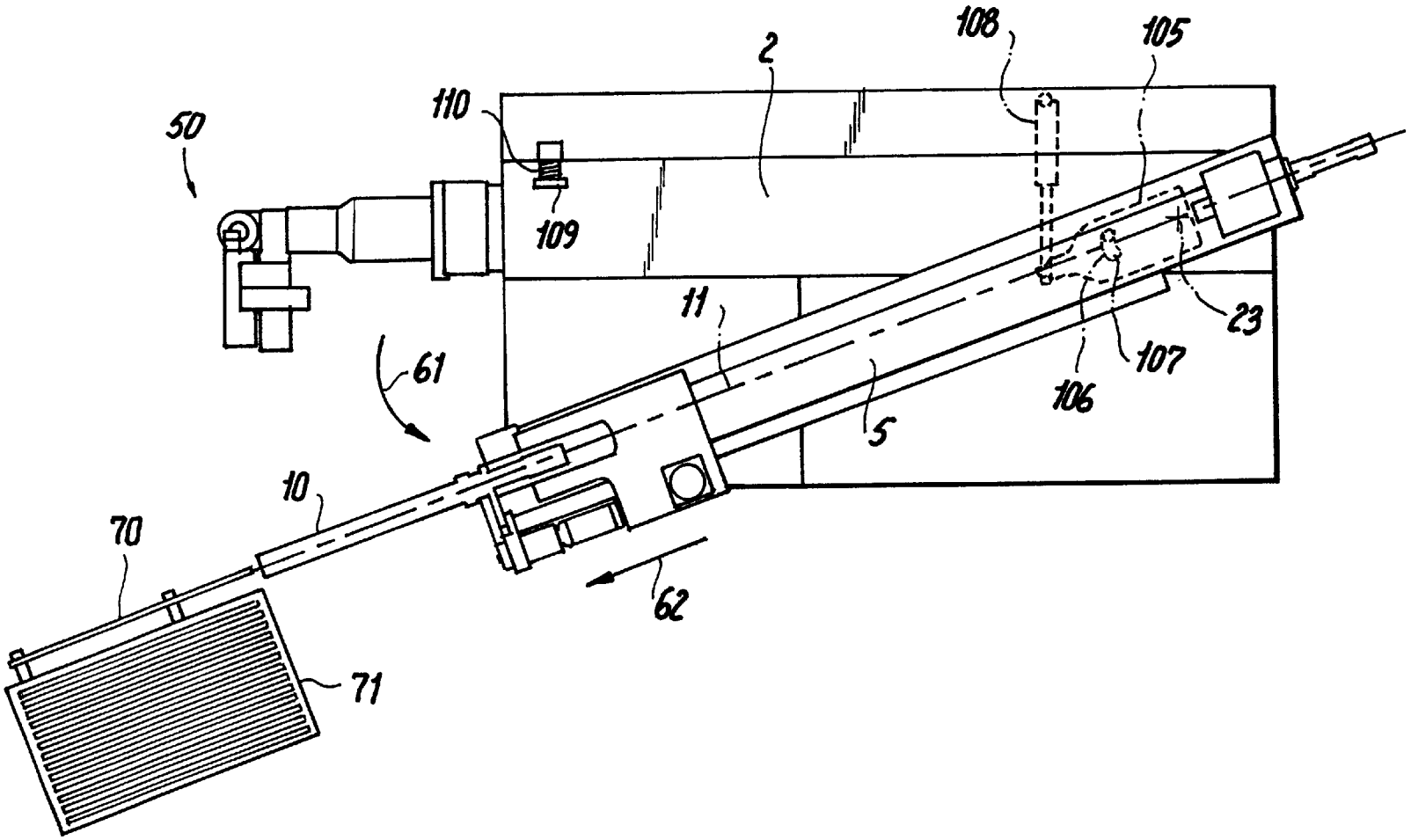
FIGS. 3 and 4 are two schematic top plan views of the bending machine with the plate at different positions.

Preferably, a cylinder-piston assembly 108 is arranged inside the body of the bed 2 (FIG. 3). The end of the piston is coupled to the plate 5 through an articulated joint.

The cylinder and piston assembly 108 is supplied by a hydraulic circuit (not shown).

Advantageously, servovalves are arranged in said hydraulic circuit.

According to a modified embodiment, a driving lever 105 is arranged between the plate 5 and bed 2.

The driving lever 105 is provided, at one end thereof, with a throughgoing hole in which is housed the plate 5 swinging shaft 6.

Through the body of the lever 105 an elongated slot 106 is formed. The elongated slot 106 houses therein a vertical pin extending from the bottom surface of the plate 5.

At that end of the lever 105 opposite to the swinging shaft 6, are operatively connected said driving means.

For example, the cylinder-piston assembly 108 is coupled to said lever 105 by a ball joint.

Abutments 109 for the plate 5 are provided on the surface of the plate 5 supporting bed 2.

The abutments 109 are arranged at the standby positions of the plate 5, such as, for example, the workpiece machining and loading or unloading positions.

The abutment 109 is affixed to one end of a spring 110 connected to the free end of the bed 2.

The elongated slot 106 formed through the lever 105 has a size adapted to allow the pin 107 to perform small strokes, and, accordingly, to allow the plate 5 to perform small swinging movements. The spring 110 affecting the abutment 109 hinders said small swinging movements of the plate 5.

Thus, as the plate 5 abuts on the abutment 109, the spring 110 will resiliently hinder or counter-bias the small swinging movements occurring because of the working stress or of the workpiece loading and unloading stress.

A guide 8 is provided on the front portion of the base 2, on the top of the vertical side 4 thereof. Shoes 9 for connection to said guide are provided at the bottom of the plate 5.

A carriage provided with a gripper for gripping and locating rod or pipe lengths (not shown), generally indicated by 10, is provided on the top of the plate 5. Clamping means (not shown) of said gripper 10 define an axis 11 on which is arranged the straight length to be bent.

The gripper 10 carriage is longitudinally connected to the plate 5 for example by connecting guides (not shown) parallel to the axis 11 of the gripper 10.

Servomotors 12, 13 are operatively coupled to the gripper 10 and carriage.

The servomotors 12, 13 allow to adjust the angular position of the gripper 10 about the axis 11 (as shown by the arrow z) and the feeding on the plate 5 of the gripper 10 supporting carriage (according to the arrow x).

At the rear portion of the plate 5 is provided a known type of ejector, generally indicated by 15, aligned with the axis 11 of the gripper 10.

On the front of the bed 2 a head 20 is provided.

The head 20 is operatively coupled to the front of the bed 2. The operative coupling of the head 20 and bed 2 allows the head 20 to be translated or both translated and rotated.

A known bending unit, generally indicated by 50, is provided, for example, at one end 21 of the head 20.

The bending unit 50 comprises a swinging arm 51 which can controllably swing (in the direction of the arrow y) about a pin (not shown) perpendicular to the axis 11 of the gripper 10. The pin defines the bending axis 52 of the machine 1.

A cabinet 60, supported by the bed 2 at the rear portion thereof, houses therein the driving and controlling unit of the servomotors which drive the axes of the machine 1.

The driving or controlling units are coupled to a known type of digital control unit (not shown). Known sensors (not shown), arranged on different operating or driving elements of the machine, provide a feedback control for the digital control unit.

The cabinet 60 is housed inside the space defined by the L-shape of the bed 2.

Figure 4:
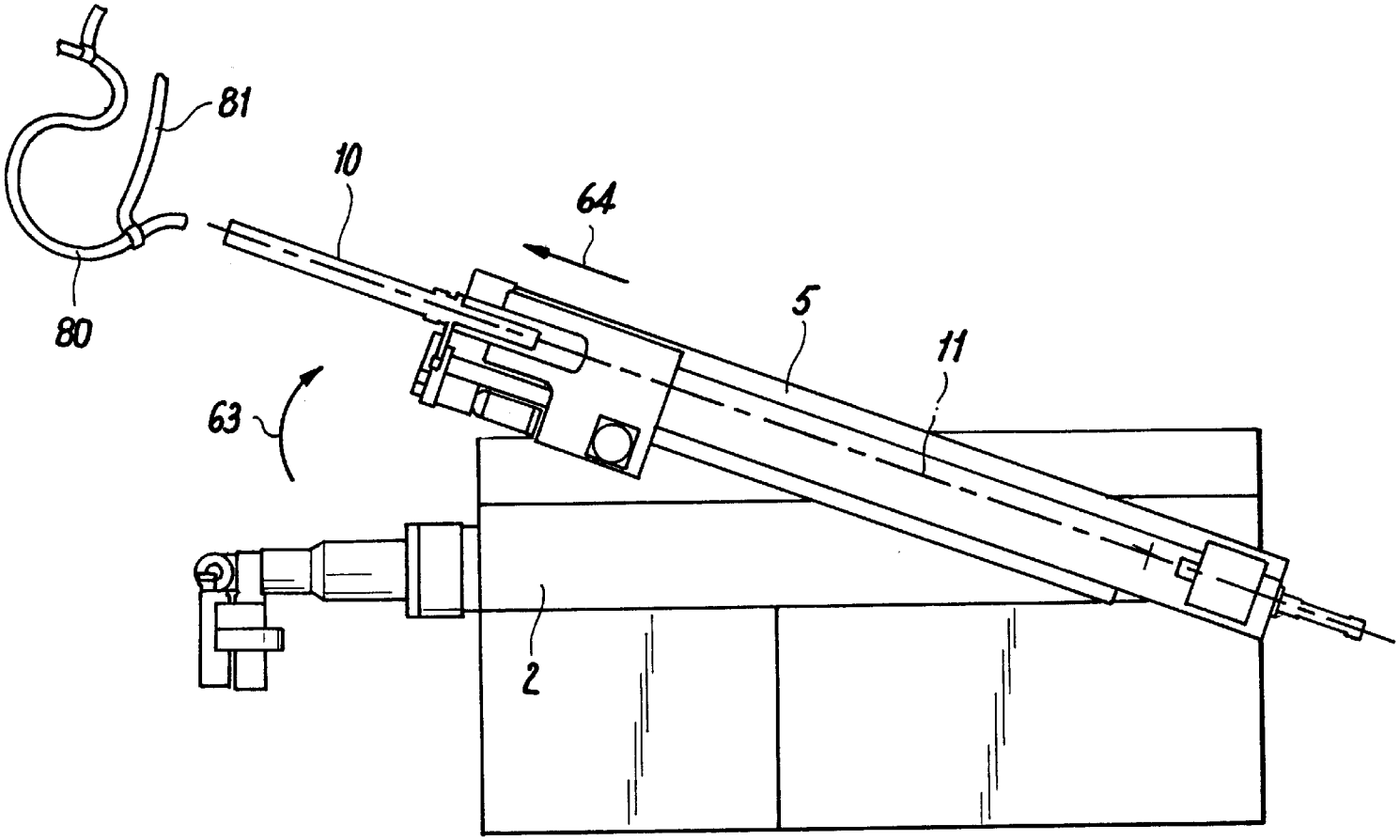

With reference to FIGS. 3 and 4, the operation of the plate 5 will be hereinbelow disclosed.

To that end, is considered an example in which the plate 5 is used as a handling device during an operating step in which a straight rod or pipe length 70 is taken up from a loading station 71 and in which the plate 5 is used during an operating stop in which a contoured length 80 is arranged in a station 81 for taking up a further machining unit.

By observing the machine 1 from the top, the plate 5 is caused to anticlockwise swing (according to the arrow 61) so as to align the axis 11 of the gripper 10 with the straight rod or pipe length 70 to be gripped, provided in the supplying station. Then, the gripper 10 is spread apart. The gripper is driven (according to the arrow 62), toward the supplying station so as to engage the end portion of the length 70 facing the machine 1 in the gripper 10.

Upon clamping the gripper, the length 70 is taken up by withdrawing the gripper on the plate 5. Then the plate 5 is caused to anticlockwise swing so as to align the axis 11 of the gripper 10 with the bending unit 50.

The, known bending operations are performed.

After having contoured as desired the length 80, the plate 5 is caused to swing in a clockwise direction (according to the arrow 63) and the gripper 10 is extended so as to align the length 80 with a station 81 for taking up a further machining unit, such a butting unit.

I claim:

1. A bending machine (1) for bending an elongated workpiece comprising:

a machine bed (2);

a bending head (20) supported by the machine bed;

a plate (5) rotatably supported by the machine bed along a swinging axis (23) positioned at one end of the plate (5);

a carriage supported on the plate and having a gripper (10) for gripping a workpiece in alignment with a gripper axis, said gripper axis being substantially perpendicular to said swinging axis; and a driving and swinging means coupled to said plate (5) for swinging said plate about the swinging axis (23) in a controlled manner.

2. The bending machine (1) of claim 1, wherein said swinging driving means is controllable in a continuous manner.

3. The bending machine of claim 1, further comprising:

a guide (8) mounted on the surface of the machine bed (2) and facing said plate (5); and sliding shoes (9) positioned on the bottom surface (7) of said plate (5) and being in alignment with guide (8).

4. A bending machine for bending an elongated workpiece comprising:

a machine bed (2);

a bending head (20) supported by the machine bed;

a plate (5) rotatably supported by the machine bed along an axis (23) positioned at one end of the plate (5);

a carriage supported on the plate and having a gripper (10) for gripping a workpiece;

a driving and swinging means coupled to said plate (5) for swinging said plate about the axis (23) in a controlled manner;

a shaft (6) extending from the bottom surface (7) of the plate (5), being rotatably housed in said machine bed (2) and operatively coupled to driving means.

5. The bending machine of claim 4, further comprising thrust bearings (100, 101) keyed on the shaft (6) and housed in seats formed in the machine bed (2).

6. The bending machine of claim 3, further comprising a gear wheel (103) keyed on the shaft (6), and a servocontrolled geared motor (102) mounted to the machine bed (2) and coupled to said gear wheel (103).

7. A bending machine for bending an elongated workpiece comprising:

a machine bed (2);

a bending head (20) supported by the machine bed;

a plate (5) rotatably supported by the machine bed along an axis (23) positioned at one end of the plate (5);

a carriage supported on the plate and having a gripper (10) for gripping a workpiece;

a driving and swinging means coupled to said plate (5) for swinging said plate about the axis (23) in a controlled manner; and a cylinder-piston swinging driving assembly (108) mounted to said machine bed (2) and being operatively coupled to said plate (5).

8. A bending machine for bending an elongated workpiece comprising:

a machine bed (2);

a bending head (20) supported by the machine bed;

a plate (5) having first and second ends and being rotatably supported by the machine bed along an axis (23) positioned at the first end of the plate (5);

a carriage supported on the plate and having a gripper (10) for gripping a workpiece;

a driving and swinging means (108) coupled to said plate (5) for swinging said plate about the axis (23) in a controlled manner;

a lever (105) positioned under said plate (5) and rotatably mounted such that said lever (105) can swing about the plate (5) swinging axis (23), said lever (105) having an elongated slot (106) therein;

a pin (107) rigid with the bottom surface (7) of said plate (5) and housed within said elongated slot;

said swinging driving means (108) being operatively coupled to said lever (105);

said machine further comprising abutments (109) supported by a spring (110) mounted to said machine base (2) at a position substantially opposing the second end of said swinging plate (5).

* * * * *